US008317634B2

(12) United States Patent
Hachiro

(10) Patent No.: US 8,317,634 B2
(45) Date of Patent: Nov. 27, 2012

(54) GOLF CLUB GRIP

(75) Inventor: Toshihiko Hachiro, Osaka (JP)

(73) Assignee: Iomic, Inc., Osaka (JP)

( * ) Notice: Subject to any disclaimer, the term of this patent is extended or adjusted under 35 U.S.C. 154(b) by 160 days.

(21) Appl. No.: 12/663,780

(22) PCT Filed: Jul. 29, 2009

(86) PCT No.: PCT/JP2009/063503
§ 371 (c)(1),
(2), (4) Date: Dec. 9, 2009

(87) PCT Pub. No.: WO2011/001544
PCT Pub. Date: Jan. 6, 2011

(65) Prior Publication Data

US 2011/0165958 A1 Jul. 7, 2011

(30) Foreign Application Priority Data

Jun. 30, 2009 (JP) ..... 2009-154570

(51) Int. Cl.
*A63B 53/14* (2006.01)

(52) U.S. Cl. ..... 473/300

(58) Field of Classification Search ..... 473/300–303
See application file for complete search history.

(56) References Cited

U.S. PATENT DOCUMENTS

| | | | | |
|---|---|---|---|---|
| 5,322,290 | A | 6/1994 | Minami | |
| 5,653,643 | A * | 8/1997 | Falone et al. | 473/300 |
| 6,200,685 | B1 * | 3/2001 | Davidson | 428/472.1 |
| 7,264,759 | B2 | 9/2007 | Lamkin | |
| 2004/0220000 | A1 * | 11/2004 | Falone et al. | 473/568 |

FOREIGN PATENT DOCUMENTS

| | | |
|---|---|---|
| JP | 63267898 | 11/1988 |
| JP | SHO 64-037968 | 2/1989 |
| JP | HEI 4-95064 | 8/1992 |
| JP | HEI 6-7766 | 2/1994 |
| JP | HEI 7-39869 | 7/1995 |
| JP | 10-015135 | 1/1998 |
| JP | 2001146815 | 5/2001 |
| JP | 2003-117934 | 4/2003 |
| JP | 2004275324 | 10/2004 |
| JP | 2005034550 | 2/2005 |
| JP | 2005-313576 | 11/2005 |
| JP | 2007117109 | 5/2007 |
| JP | 2007275443 | 10/2007 |

* cited by examiner

*Primary Examiner* — Stephen L. Blau
(74) *Attorney, Agent, or Firm* — 24IP Law Group; Timothy R. DeWitt

(57) ABSTRACT

To provide a golf club grip in which torsional deformation is suppressed without impairing a grip feeling.

A grip 10 has en inner layer portion 23, an intermediate layer portion 24, and an outer layer portion 25. Resin films 26 and 27 are disposed between the respective layer portions. The outer layer portion 25 is formed of sort rubber and the intermediate layer portion 24 and the inner layer portion 23 are formed of hard rubber. The resin sheets 26 end 27 are constituted as a nonwoven fabric formed of aramid fibers. The Young's modulus Es of the resin sheets 26 and 27 is adjusted to be larger than the Young's modulus (Ei, Ec, Eo) of the inner layer portion 23, the intermediate layer portion 24, and the outer layer portion 25, and a relationship of $Eo<Ec \leqq Ei<Es$ is established.

4 Claims, 6 Drawing Sheets

(A)

(b)

GOLF CLUB GRIP

TECHNICAL FIELD

The present invention relates to the structure of golf club grips.

BACKGROUND ART

A golf club is generally provided with a shaft, a head disposed at the top end of the shaft, and a aria disposed at the rear end of the shaft. When golfers hit a ball, the impact angle of the head face and the ball has a great influence on the direction of the hit ball. In order to send a ball in the direction desired by the golfers, it is important the ball hits the heed face at right angles.

The impact force applied to golf clubs at the moment of impact of the head and the ball is large. It has been considered until now that the impact force has the following influences on golf clubs. More specifically, it has been considered that the impact force causes torsional deformation in the shaft, so that the head face hits the ball at a vertically inclined angle relative to the ball, and thus the direction of the hit ball deviates from the direction desired by a golfer. Based on such an idea, various measures for suppressing the torsional deformation of the shaft have been proposed until now e.g., Patent Documents 1 to 4).

PRIOR ART REFERENCES

Patent Documents

Patent Document 1: Japanese Unexamined Patent Application Publication No. 2007-275443

Patent Document 2: Japanese Unexamined Patent Application Publication No. 2005-034559

Patent Document 3: Japanese Unexamined Patent Application Publication No. 2004-275324

Patent Document 4: Japanese Unexamined Patent Application Publication No. 2007-117109

SUMMARY OF THE INVENTION

Problems to be solved by the Invention

However, even when only the torsional deformation of shafts has been studied, a phenomenon in which the direction of a hit ball deviates from the direction desired by golfers actually occurs. The present inventors of this application have focused on the fact that a grip as a component of golf clubs is markedly rich in elasticity cornered with shafts, while studying the cause of the phenomenon. More specifically, the present inventors have obtained a finding that although it is clear that the impact force causes torsional deformation in the shaft, a shift in the impact angle or the head face and a ball greatly depends on that the grip elastically deforms due to the impact force, and thus the shift in the impact angle of the head face and the ball by improving the structure of the grip is suppressed.

A grasp feeling (grip feeling) of the grip for golfers is a very important factor when the golfers hit a ball in the direction desired by the golfers. As a material constituting the grip, rubber, such as ethylene propylene rubber (EPDM), may be employed. Then, in order to increase the grip feeling, it is preferable to adjust the hardness of a material rubber to be low. When the material rubber constituting the grip is soft, the torsional rigidity of the grip decreases, and thus the grip extremely deforms in hitting a ball. More specifically, there is a possibility that the direction of the hit ball may greatly deviate from the direction desired by the golfer.

Rubber grips having a reinforcement sheet have also been proposed until now. The reinforcement sheet is formed into a sheet shape while fiber cords generally formed of cotton yarn are knitted therein, and is located so as to cover the outer peripheral surface of the rubber grips. Such a reinforcement sheet demonstrates an effect as an anti-slipping member at the time of sweating but does not increase the torsional rigidity of the grips. Thus, the reinforcement sheet has not suppressed the shift in the impact angle.

The present invention has been made under the circumstances. It is an object of the present invention to provide golf club grips that allow golfers to obtain a favorable grip facing and to send a ball in the direction desired by the golfers.

Means for Solving the Problems (1) In order to achieve the object, a golf club grip according to the present invention has a grip body that is formed into a cylindrical shape having a peripheral wall of a given thickness dimension and is to be disposed on a golf club shaft. The peripheral wall has a structure in which a plurality of layer portions at least including a first layer portion to be engaged in the golf club shaft and a second layer forming the surface of the grip body are laminated, in the diameter direction of the grip body with a sheet member being disposed on each of the boundaries of the respective layer portions. The respective layer portions are formed of rubber and the hardness of the second layer is adjusted to be lower than that of the remaining layer portions. The elastic modulus of the sheet members is adjusted to be larger than that of the respective layer portions.

According to the structure, the peripheral wall of the grip body at least contains three members of the first layer portion, the sheet member, and the second layer portion. More specifically, the first layer portion of the grip body is engaged in the golf club shaft, and the sheet member is located outside the diameter direction of the second layer portion. Furthermore, the second layer portion is located outside the diameter direction of the sheet member. The first layer portion, the sheet member, and the second layer portion are laminated in the diameter direction to form a laminated structure. The second layer portion forms the surface of the grip body. Therefore, during use of the golf club, golfers hold the second layer portion. It is a matter of course that the second layer portion may be constituted by a plurality of layer portions. In such a case, the sheet member is located on each of the boundaries of the respective layer portions.

The second layer portion is a member whose hardness is the lowest among the members constituting the grip body, and thus the surface of the grip body is soft. Therefore, a favorable grip feeling for golfers, i.e., a grasp feeling, is obtained.

By providing the sheet member, the relatively soft second layer portion is divided and partitioned from relatively hard layer portions (layer portions other than the second layer portion). More specifically, when the wall thickness dimension of the peripheral wall of the grip body is defined as t, the grip body is divided into a portion of a wall thickness t2 (second layer portion) and the remaining portions having a wall thickness of t1.

The impact force generated when golfers hit a ball acts on the peripheral surface of the grip body as a couple of forces. Since the elastic modulus of the sheet member is adjusted to be larger than the elastic modulus of the respective layer portions, the second layer portion is divided and partitioned by the sheet member having a high elastic modulus. Therefore, the portion of the wall thickness t2 (second layer portion) mainly elastically deforms by the couple of forces. Therefore, the torsional deformation occurring in the grip body due to the couple of forces is small compared with the case where the laminated structure is not formed. This is based on the following reason. When the sheet member is not provided, the couple of forces uniformly acts throughout the grip body (all regions in the diameter direction), and the peripheral wall of the grip body uniformly deforms in the diameter direction. Therefore, the torsional deformation occurring in the grin body increases. In contrast, when the sheet member is provided, the second layer portion (portion of the wall thickness t2) of the grip body mainly deforms. Thus, the torsional deformation occurring in the grip body becomes small. More specifically, the torsional deformation of the grip body in hitting a ball is suppressed.

(2) It is preferable that the sheet member be formed into a cylindrical shape in such a manner as to surround a layer portion positioned inside toe diameter direction.

According to the structure, portions other than the second layer portion of the peripheral wall of the grip body are surrounded by the sheet member. Therefore, the couple of forces mainly acts on the outer portion (second layer portion) of the grip body. Thus, the torsional deformation occurring in the grip body mainly occurs in the second layer portion (portion of the wall thickness t2). Therefore, the torsional deformation occurring in the grip body in hitting a ball is further suppressed.

(3) The peripheral wall may be formed by laminating an inner layer portion, an intermediate layer portion, an outer layer portion, and two sheet members each disposed on any one of the boundary of the inner layer portion and the intermediate layer portion and the boundary of the intermediate layer portion and the outer layer portion in the diameter direction. In such a case, it is preferable that when the Young's modulus of the inner layer portion, the intermediate layer portion, the outer layer portion, and the sheet members is Ei, Ec, Eo, and Es, respectively, the relationship of $Eo<Ec\leqq Ei<Es$ be established.

In the structure, the grip body has a 5 layer structure. More specifically, the grip body has the inner layer portion, the sheet member, the intermediate layer portion, the sheet member, and the outer layer in order from the outside to the inner side in the diameter direction. The Young's modulus of the inner layer portion, the intermediate layer portion, the outer layer portion, and the sheet members satisfies the relationship described above. Therefore, by adjusting the Young's modulus of the rubber constituting the outer layer portion to be small and the wall thickness dimension of the outer layer portion to be in a necessary and sufficient range, the torsional deformation of the grip body is suppressed while obtaining a favorable grip feeling (grasp feeling) for golfers.

(4) The sheet member may be formed of poly praraphenylene terephthalamide. In such a case, it is preferable to adjust the well thickness dimension of the sheet member to be equal to or more than 0.25 mm and equal to or less than 0.45 mm.

When the sheet member is formed of poly praraphenylene terephthalamide, the tension strength of the sheet member becomes very large. Therefore, the wall thickness dimension of the sheet member can be adjusted to be very small. Thus, in comparison with former grip bodies, grins that golfers most easily grasp are designed without increasing the outer diameter of the grip body. The poly paraphenylene terephthalamide is a so-called para aramid fiber.

EFFECTS OF THE INVENTION

According to the golf club grip of the present invention, even when the surface of the grip body is formed of a low elasticity rubber, the torsional deformation of the grip body in hitting a ball is suppressed and also the shift in the impact angle of the club face and the ball generated at the moment of impact is suppressed. As a result, a grip feeling favorable for golfers is obtained and also a ball can be sent in the direction desired by the golfers.

BRIEF DESCRIPTION OF THE DRAWINGS

FIG. 3(*a*) is a right side view and FIG. 3(*b*) is a left side view.

BEST MODES FOR CARRYING OUT THE INVENTION

Hereinafter, the present invention will be described in detail based on preferable embodiments with reference to the drawings. It is a matter of course that each embodiment described below is simply one embodiment of the invention, and can be modified insofar as the gist of the invention is not altered.

Figure 1:
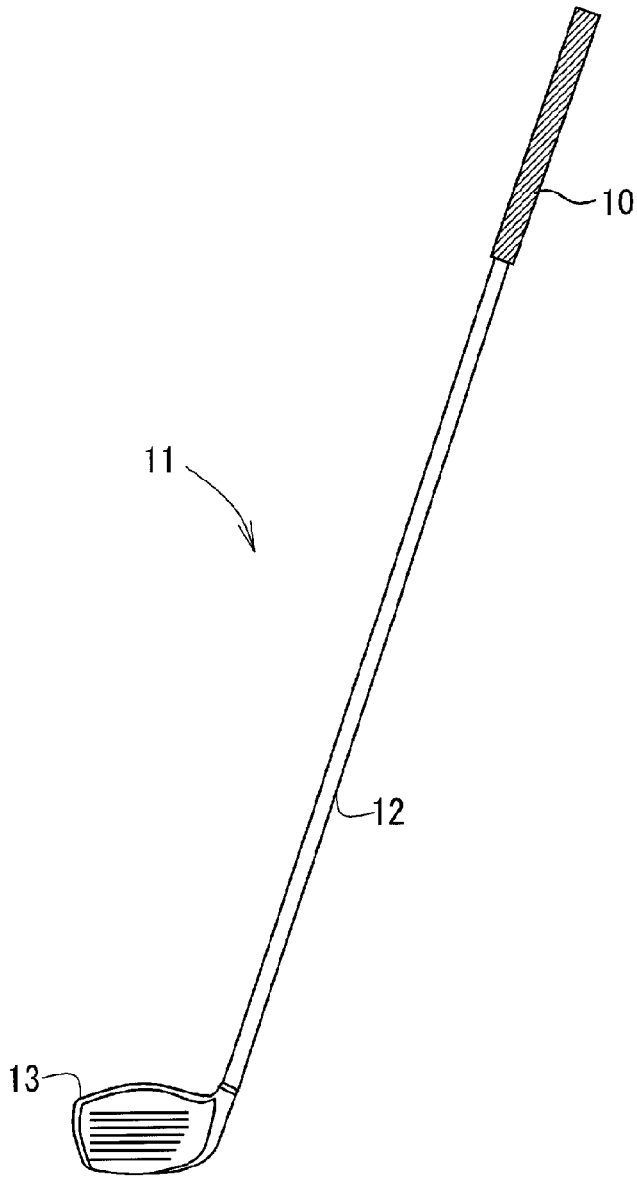
FIG. 1 is a front elevation view of a golf club employing a grip according to one embodiment of the invention.

FIG. 1 is a front elevation view of a golf club 11 employing a golf club grip 10 according to are embodiment of the invention (hereinafter referred to as a "grip").

The golf club 11 is a wood type golf club. The golf club 11 has a shaft 12, a head 13, and a grip 10. The head 13 is attached to the front end portion of the shaft 12. The rear end portion of the shaft 12 is inserted into the grip 10. The shaft 12 is formed of stainless steel or fiber reinforced resin. The grip 10 can also be employed for iron clubs.

Figure 2:
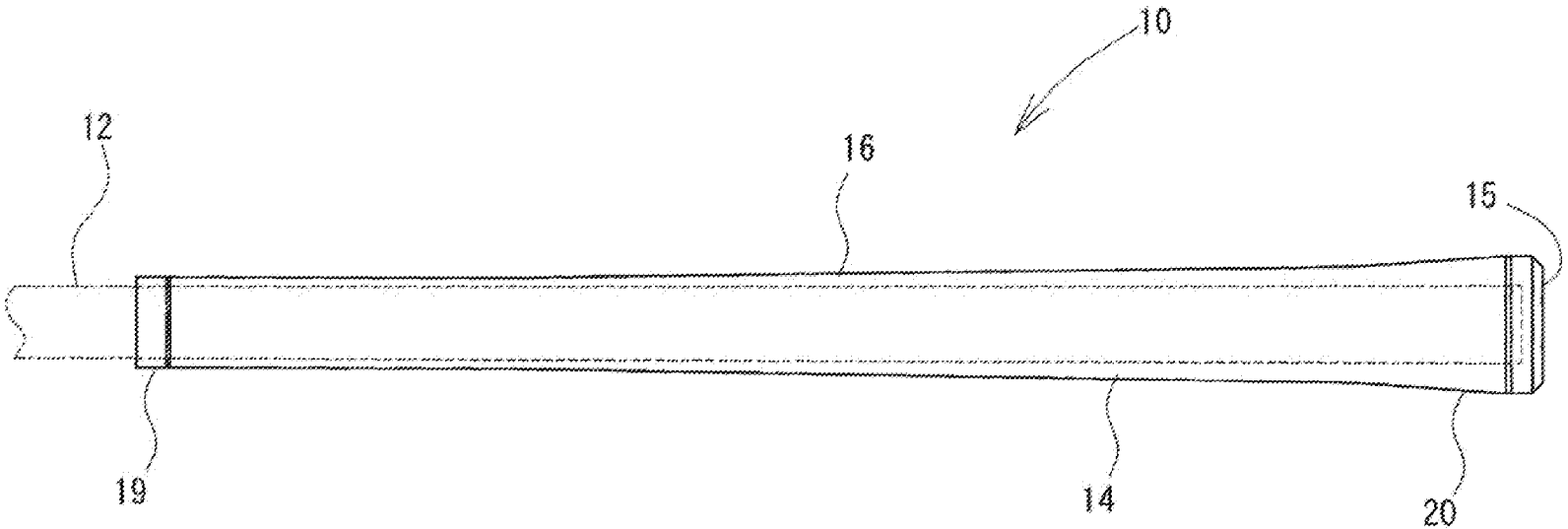
FIG. 2 is a front elevation view of a grip according to one embodiment of the invention.
Figure 3:
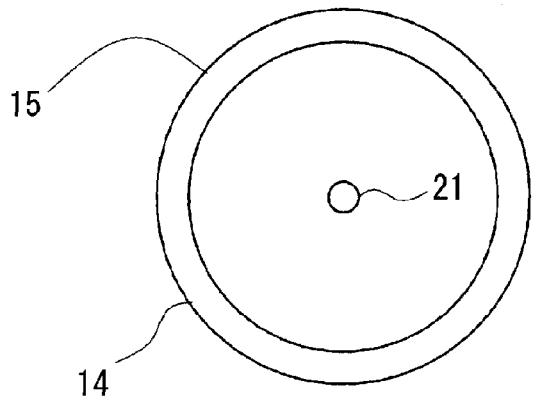
FIG. 3 is a side view of a grip according to one embodiment of the invention.
Figure 3:
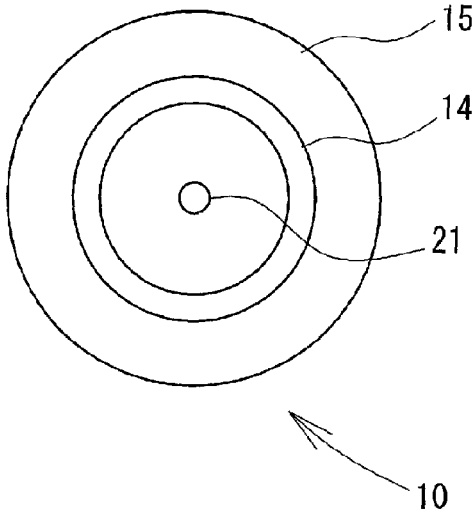

FIG. 2 is a front elevation view of the grip. FIGS. 3(*a*) and 3(*b*) are views illustrating the right side surface and the left side surface of the grip, respectively. These figures illustrate the outer shape of the grip.

The grip 10 is a member to be gripped by golfers during use of the golf club 11, and thus is requested to have a shape that is easily grasped by the golfers. Therefore, the grip 10 according to this embodiment is formed into a cylindrical shape, and the cross sectional shape thereof is circular. The grip 10 has a grip body 14 and an end cap 15. The grip body 14 and the end cap 15 are formed of rubber (typically ethylene propylene rubber (EPDM)), and are integrally molded. As described above, the shaft 12 is engaged and fixed in the grip 10. The cross sectional shape of the grip is not limited to a circular shape and may be a polygon.

As the rubber constituting the grip body 14 and the end cab 15, nitrile rubber (NBR), hydrogenated nitrile rubber (HNBR), acrylic rubber (ACM), silicone rubber (VMQ), fluorosilicone rubber (FVMQ), fluorine rubber (FKM), chloroprene rubber (CR), chlorosulfonation polyethylene (CSM), styrene butadiene rubber (SBR), isobutylene isoprene rubber (IIR), polyurethane rubber (AU), and other rubbers can be employed in place of EPDM. The hardness H of these rubbers can be adjusted to be equal to or more than 48 and less than 75 (JIS K 6253 Type A). The hardness H of the rubber constituting the end cap 15 may be adjusted to 70 or more (JIS K 6253 Type A).

Figure 4:
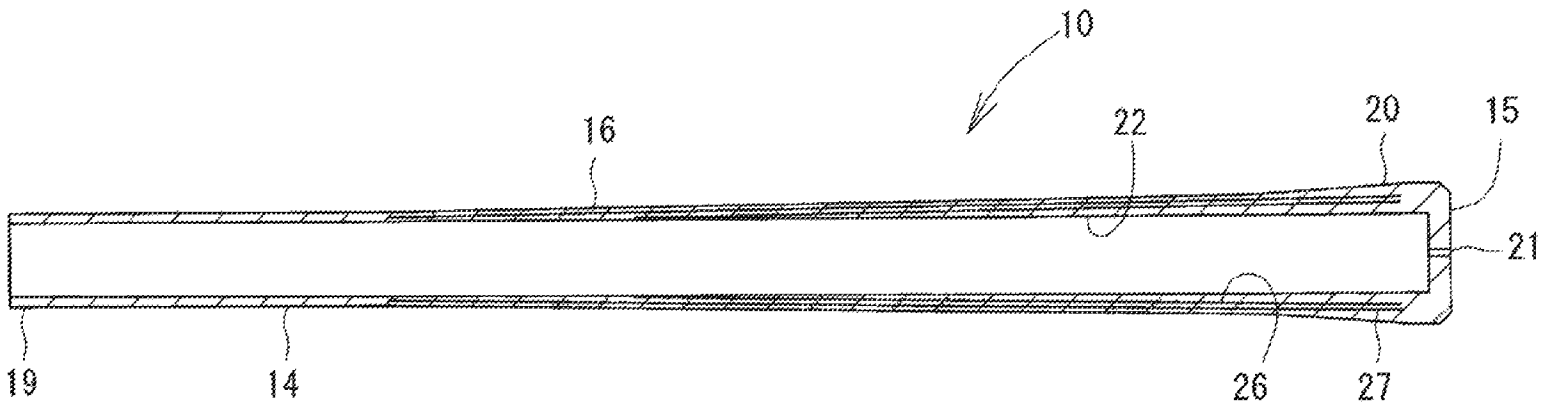
FIG. 4 is a vertical cross sectional view of a grip according to one embodiment of the invention.
Figure 5:
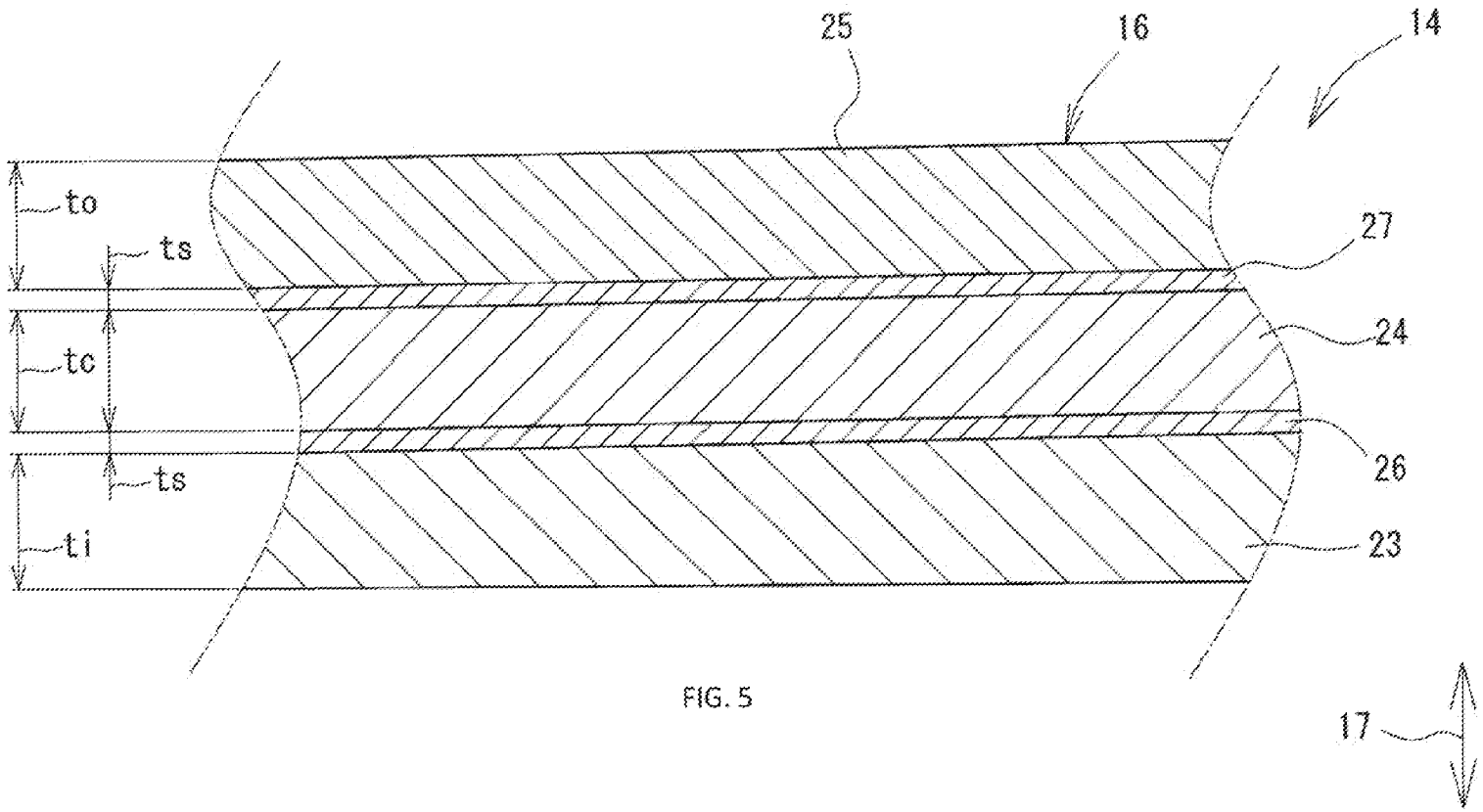
FIG. 5 is an enlarged view of an essential part of FIG. 4.
Figure 6:
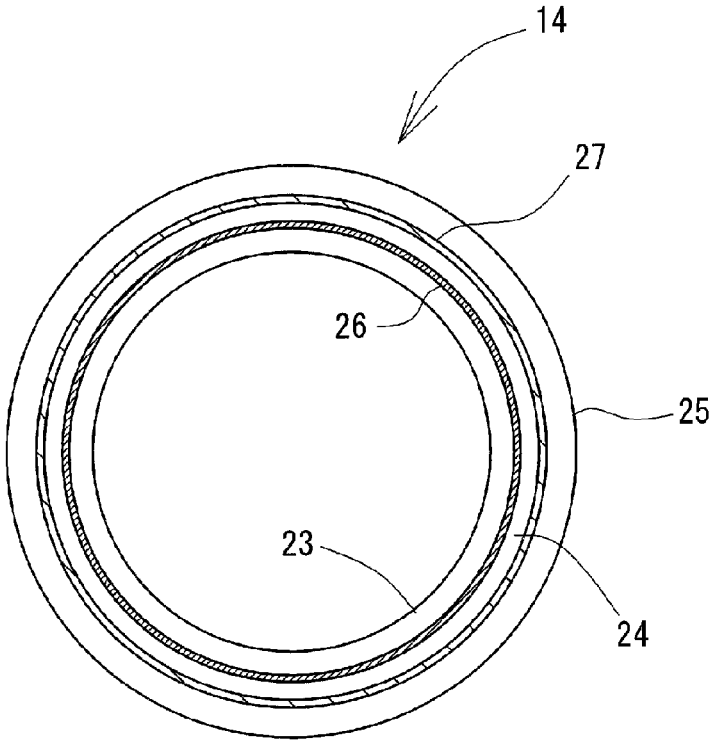
FIG. 6 is an enlarged transverse cross sectional view of a grip according to one embodiment of the invention.

FIG. 4 is a vertical cross sectional view of the grip 10. FIG. 5 is an enlarged view of an essential portion of FIG. 4, and illustrates the internal structure of a peripheral wall 16 of the grip body 14 in detail. In FIG. 5, the lower portion of the sheet is the inside of the grip body 14. FIG. 6 is an enlarged transverse cross sectional, view of the grip 10.

A feature of the grip 10 according to this embodiment resides in that the peripheral wall 16 of the grip body 14 is formed of rubber and resin sheets 26 and 27 (one example of the "sheet member" in the invention) are embedded in the peripheral wall 16, that the peripheral wall 16 of the grip body 14 is divided into three layer portions (the inner layer portion 23, the intermediate layer portion 24, and the outer layer portion 25) by the resin sheets 26 and 27 in the diameter direction 17 (FIG. 5), that the outer layer portion 25 is formed of rubber softer than that of the remaining layer portions, and that the Young's modulus of the resin sheets 26 and 27 is adjusted to be larger than the Young's modulus of the respective layer portions 23 to 25. Hereinafter, the structure of the grip 10 will be described in detail.

As described above, the grip body 14 and the end cap 15 are integrally formed. A molding manner at the grip 10 will be described later.

The grip body 14 is formed into a cylindrical shape. As illustrated in FIG. 1, the outer diameter of a top end portion 19 of the grip body 14 is adjusted to be smaller than the outer diameter or a rear end portion 20 and the outer shape of the grip body 14 is tapered. According to this embodiment, the outer diameter of the top end portion 19 is adjusted to 17 mm and the outer diameter of the rear end portion 20 is adjusted to 26 mm. The design of the outer diameter of the top end portion 19 and the rear end portion 29 may be changed as appropriate, so that the outer shape or the peripheral wall 16 is designed for golfers to easily grasp. The top end of the grip body 14 is opened, and a shaft 12 is inserted from the top end portion 19 of the grip body 14. The end cap 15 is provided at the rear end of the grip body 14 and the rear end is blocked by the end cap 15. A small hole 21 is formed at the center of the end cap 15. The small hole 21 penetrates the end cap 15.

The wall thickness dimension of the peripheral wall 16 of the grip body 14 is adjusted to about 1.5 mm to 6.0 mm. In the grip body 14 according to this embodiment, the wall thickness dimension of the top end portion 19 is adjusted to 2.0 mm and the wall thickness dimension of the rear end portion 20 is adjusted to 6.0 mm. The wall thickness of the peripheral wall 16 or the grip body 14 becomes gradually larger from the top end portion 19 to the rear end portion 20.

The grip body 14 has the resin sheets 26 and 27. The resin sheets 26 and 27 are formed of poly paraphenylene terephthalamide (para aramid fiber) in this embodiment. Specifically, the resin sheets 26 and 27 are nonwoven fabrics formed of para aramid fiber. The Young's modulus Es of the para aramid fiber may be adjusted in the range of 7300 kg/mm$^2$ to 11100 kg/mm$^2$. In this embodiment, the Young's modulus Es is adjusted to 7320 kg/mm$^2$. In this embodiment, the wall thickness dimension ts of the resin sheets 26 and 27 is adjusted to 0.3 mm. The wall thickness dimension ts of the resin shoots 26 and 27 may be adjusted in the range of 0.25 mm to 0.45 mm. Materials constituting the resin sheets 26 and 27 are not limited to the pare meld fiber, and resin sheets formed of nylon fiber or other resin fibers in place of the pare aramid fiber or sheets formed of cotton yarn may also be employed. In short, sheets having a Young's modulus larger than the Young's modulus of the rubber constituting the grip body 14 may be acceptable.

The resin sheets 26 and 27 are formed into a cylindrical shape. As illustrated in FIG. 4, the resin sheets 26 and 27 are embedded in the peripheral wall 16 of the grip body 14. By providing the resin sheets 26 and 27, in the grip body 14, the inner layer portion 23 (one example of "the first layer portion" in the invention), the resin sheet 26, the intermediate layer portion 24 (one example of "the first layer portion" in the invention), the resin sheet 27, and the outer layer portion 25 (one example of the "second layer portion" in the invention) are: successively laminated along the diameter direction 17. The inner layer portion 23 is formed of EPDM and the hardness Hi thereof is adjusted to 70 (JIS K 6253 Type A). The intermediate layer portion 24 is also formed of EPDM and the hardness Ho thereof is adjusted to 70 (JIS K 6253 Type A). The outer layer portion 25 is also formed of EPDM. The hardness Ho of the outer layer portion 25 is adjusted to 50 (JIS K 6253 Type A).

As illustrated in FIGS. 5 and 6, the resin sheet 26 surrounds a layer portion inside the diameter direction 17 of the grin body 14, i.e., the inner layer portion 23. The resin sheet. 27 similarly surrounds the intermediate layer portion 24. In this embodiment, the grip body 14 is formed into a cylindrical shape, and thus the resin sheets 26 and 27 are also formed into a cylindrical shape. When the cross sectional shape of the grip body 14 is a polygon, it is preferable that the cross sectional shape of the resin sheets 26 and 27 be formed corresponding to the cross sectional shape of the grip body 14. In this embodiment, the resin sheet 26 is located inside the diameter direction 17 of the peripheral wall 16 of the grip body 14 and the resin sheet 27 is located outside the diameter direction 17 of the resin sheet 26 in such a manner as to surround the resin sheet 26.

The hardness Hi of the inner layer portion 23, the hardness Ho of the intermediate layer portion 24, and the hardness Ho of the outer layer portion 25 are adjusted as described above. Thus, between the Young's modulus Ei of the inner layer portion 23, the Young's modulus Ec at the intermediate layer portion 24, and the Young's modulus Eo of the outer layer portion 25, the relationship of $Ei \geqq Ec > Eo$ is established. As described above, the elastic modulus Es, of the resin sheets 26 and 27 is adjusted to be extremely high. Therefore, the relationship of $Eo < Ec \leqq Ei < ES$ is established between the respective elastic moduli. Furthermore, the wall thickness dimension t1 of the inner layer portion 23, the wall thickness dimension to of the intermediate layer portion, and the wall thickness dimension to of the outer layer portion 25 are the same in this embodiment. More specifically, in this embodiment, the peripheral wall 16 of the grip body 14 is equally divided into three portions by the resin sheets 26 and 27. The peripheral wall 16 may not be equally divided into three portions. It is preferable that the wall thickness dimension to of the outer layer portion 25 be adjusted to about 0.8 mm to 1.2 mm.

Next, the grip 10 is molded by a known method. A method for molding the grip 10 described below is one example, and the molding method is not limited thereto.

More specifically, the grip 10 is molded by vulcanization molding. First, a rubber sheet corresponding to the inner layer portion 23, the intermediate layer portion 24, and the outer layer portion 25 is primarily vulcanized. The wall thickness of the rubber sheet corresponds to the wall thickness dimension t1 of the inner layer portion 23, the wall thickness dimension to of the intermediate layer portion, and the wall thinness dimension to of the outer layer portion 25. The resin sheet 27 is disposed of the rubber sheet corresponding to the outer layer portion 25. The rubber sheet corresponding to the intermediate layer portion 24 is disposed thereon, and the resin sheet 26 disposed on the rubber sheet. Furthermore, the rubber sheet corresponding to the inner layer portion 23 is disposed on the resin sheet 26. Thus, the inner layer portion 23, the intermediate layer portion 21, the outer layer portion 25, and the resin sheets 26 and 27 are laminated, thereby forming a 5 layer portion structure. Next, the inner layer portion 23, the intermediate layer portion 24, the outer layer portion 25, and the resin sheets 26 and 27 thus laminated are disposed in a given die, and are secondarily vulcanized to be formed into a cylindrical shape. Thus, the grip 10 is formed.

Golfers grasp the grip 10 according to this embodiment, and shot a ball using a golf club. In the grip 10, the peripheral wall 16 of the grip body 14 is divided into the inner layer portion 23, the intermediate layer portion 24, and the outer layer portion 25 by the resin sheets 26 and 27. When golfers grasp the grip 10, the golfers hold the outer layer portion 25. Since the outer layer portion 25 is a soft member having a low hardness, a favorable grip feeling for golfers, i.e., a grasp feeling, is obtained.

In the grip 10, a relatively soft portion (outer layer portion 25) is divided and partitioned from a relatively hard portion (portions other than the outer layer portion 25). More specifically, as illustrated in FIG. 5, the soft outer layer portion 25 (wall thickness to) is divided from the hard the intermediate layer portion 24 and the hard inner layer portion 23 (wall thickness tc+ti). Therefore, the impact force generated when golfers hit a ball mainly acts as a couple of forces on the outer layer portion 25, and thus the grip 10 torsionally deforms. However, in this embodiment, the outer layer portion 25 mainly torsionally deforms by the couple of forces, and thus, the torsional deformation occurring in the grip 10 is suppressed. This is because when the peripheral wall 16 is constituted by a single material without providing the sheet members 26 and 27 on the peripheral wall 16 of the grip 10, the peripheral wall 16 entirely uniformly deforms by the couple of forces, and thus the deformation occurring in the grip 10 becomes large. In this embodiment, since the outer layer portion 25 is divided by the resin sheets 26 and 27 as described above, the wall thickness of the outer layer portion 25 that is likely to deform becomes relatively small, and, as a result, the torsional deformation occurring throughout the grip 10 becomes small.

Thus, even when the surface of the grip 10 is formed of soft rubber, the torsional deformation of the grip 10 in hitting a ball is suppressed. Therefore, the shift in the impact angle of the club face and the ball produced at the moment of impact is suppressed. Therefore, a favorable grip feeling for golfers is obtained and also golfers can send a ball in the direction desired by the golfers.

In the grip 10 according to this embodiment, the resin sheets 26 and 27 are formed into a cylindrical shape, and thus, the outer layer portion 25 is surely divided from other portions in the diameter direction. Therefore, the couple of forces for deforming the grip 10 mainly acts on the outer layer portion 25, and thus the torsional deformation occurring in the grip body 16 mainly occurs in the outer layer portion 25 (portion of the wall thickness to). Therefore, there is an advantage in that the torsional deformation occurring in the grip 10 in hitting a ball is further suppressed.

In this embodiment, the Young's modulus Ec of the intermediate layer portion 24 and the Young's modulus Ei of the inner layer portion 23 are the same, and the relationship of $Ec \leqq Ei$ may established. More specifically, the inner layer portion 23 may be constituted by a material harder than that of the intermediate layer portion 24. In such a case, the torsional deformation of the entire grip 10 is further suppressed.

In this embodiment, since the resin sheets 26 and 27 are formed of para aramid fiber, the Young's modulus is very high and, moreover, the resin sheets 26 and 27 are formed to be extremely thin. Therefore, in comparison with former grips, the grip 10 that golfers easily grasp is designed without increasing the outer diameter of the grip body.

In this embodiment, although the peripheral wall 16 of the grip body 14 has the inner layer portion 23, the intermediate layer portion 24, and the outer layer portion 25, a portion inside the outer layer portion 25 may be a single layer or a multi layer insofar as the outer peripheral surface of the grip body 14 is constituted by the relatively soft outer layer portion 25. In short, the hardness of the outer layer portion 25 may be adjusted to be smaller than the hardness of the portion inside the outer layer portion 25. Also in such a case, the elastic modulus of the resin sheets 26 and 27 needs to be adjusted to be larger than the elastic modulus of the outer layer portion 25 and the portion inside thereof.

DESCRIPTION OF REFERENCE NUMERALS

10 . . . Grip
11 . . . Golf club
12 . . . Shaft
14 . . . Grip body
16 . . . Peripheral wall
17 . . . Diameter direction
23 . . . Inner layer portion
24 . . . Intermediate layer portion
25 . . . Outer layer Portion
26 . . . Resin sheet
27 . . . Resin sheet

The invention claimed is:

1. A golf club grip, comprising:

a grip body that is formed into a cylindrical shape having a peripheral wall of a given thickness dimension and is to be disposed on a golf club shaft;

the peripheral wall having a structure in which a plurality of layer portions at least including a first layer portion to be engaged in the golf club shaft and a second layer portion forming the surface of the grip body are laminated in the diameter direction of the grip body with a sheet member being disposed on each of the boundaries of the respective layer portions;

the respective layer portions being formed of rubber;

the hardness of the second layer portion being adjusted to be lower than that of the first layer portion; and the elastic modulus of the sheet members being adjusted to be larger than that of the respective first and second layer portions;

wherein the sheet member is formed into a cylindrical shape in such a manner as to surround the first layer portion positioned inside the diameter direction, the sheet member is formed of poly paraphenylene terephthalamide, and the wall thickness dimension of the sheet member is adjusted to be equal to more than 0.25 mm and equal to or less than 0.45 mm.

2. The golf club grip comprising:

a grip body that is formed into a cylindrical shape having a peripheral wall of a given thickness dimension and is to be disposed on a golf club shaft; wherein the peripheral wall is formed by laminating an inner layer portion having a Young's modulus Ei, an intermediate layer portion having a Young's modules Ec, an outer layer portion having a Young's modulus Eo, and two sheet members having a Young's modulus Es and each sheet member disposed on any one of a boundary of the inner layer portion and the intermediate layer portion and a boundary of the intermediate layer portion and the outer layer portion in the diameter direction, and a relationship of $Eo<Ec \leqq Ei<Es$ is established.

3. The golf club grip according to claim 2, wherein at least one of said two sheet members is formed of poly paraphenylene terephthalamide, and the wall thickness dimension of the sheet member is adjusted to be equal to or more than 0.25 mm and equal to or less than 0.45 mm.

4. The golf club grip comprising:

a grip body that is formed into a cylindrical shape having a peripheral wall of a given thickness dimension and is to be disposed on a golf club shaft;

the peripheral wall having a structure in which a plurality of layer portions at least including a first layer portion to be engaged in the golf club shaft and a second layer portion forming the surface of the grip body are laminated in the diameter direction of the grip body with a sheet member being disposed on each of the boundaries of between respective layer portions;

the respective first and second layer portions being formed of rubber;

the hardness of the second layer portion being adjusted to be lower than that of the first layer portion; and the elastic modulus of the sheet member being adjusted to be larger than that of the respective first and second layer portions;

wherein the sheet member is formed of poly paraphenylene terephthalamide, and the wall thickness dimension of the sheet member is adjusted to be equal to or more than 0.25 mm and equal to or less than 0.45 mm.

* * * * *